US007394373B2

(12) United States Patent
Park et al.

(10) Patent No.: US 7,394,373 B2
(45) Date of Patent: Jul. 1, 2008

(54) IMAGE FORMING APPARATUS

(75) Inventors: Sang-Cheol Park, Suwon-si (KR); Young-min Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 142 days.

(21) Appl. No.: 11/029,357

(22) Filed: Jan. 6, 2005

(65) Prior Publication Data

US 2005/0191064 A1 Sep. 1, 2005

(30) Foreign Application Priority Data

Feb. 28, 2004 (KR) ..... 10-2004-0013784

(51) Int. Cl.
*G08B 13/14* (2006.01)

(52) U.S. Cl. ..... 340/572.1; 340/572.8; 235/375

(58) Field of Classification Search ..... 340/572.1, 340/572.4, 572.8, 10.1, 10.42, 10.51; 399/12; 235/375

See application file for complete search history.

(56) References Cited

U.S. PATENT DOCUMENTS 6,312,106 B1 * 11/2001 Walker ..... 347/50
6,332,062 B1 * 12/2001 Phillips et al. ..... 399/12
6,694,115 B2 * 2/2004 Weaver ..... 399/80
6,808,255 B1 * 10/2004 Haines et al. ..... 347/86
6,817,693 B2 * 11/2004 Phillips et al. ..... 347/19
7,018,117 B2 * 3/2006 Meier et al. ..... 400/208
2002/0113850 A1 8/2002 Wheeler et al. ..... 347/85
2002/0171703 A1 11/2002 Phillips et al. ..... 347/19
2004/0202061 A1 * 10/2004 Reasoner et al. ..... 369/30.36

FOREIGN PATENT DOCUMENTS

KR 2003-0076164 9/2003
KR 2003-0081086 10/2003
KR 2003-0093433 12/2003

* cited by examiner

*Primary Examiner*—Toan N Pham
(74) *Attorney, Agent, or Firm*—Roylance, Abrams, Berdo & Goodman, L.L.P.

(57) ABSTRACT

An image forming apparatus is provided. The apparatus includes a mainboard on which a reader is integrally installed, and a RFID (radio frequency identification) tag is installed on a cartridge within a distance capable of radio communication with the reader. Therefore, the image forming apparatus is designed such that the reader acting as a radio communication device is integrally formed on the mainboard, such that a cable connecting the reader and the mainboard is not required, and noise resulting from the cable can be prevented.

18 Claims, 3 Drawing Sheets

IMAGE FORMING APPARATUS

BACKGROUND OF THE INVENTION

This application claims the benefit under 35 U.S.C. §119(a) of Korean Patent Application No. 2004-13784, filed on Feb. 28, 2004, in the Korean Intellectual Property Office, the entire disclosure of which is hereby incorporated by reference.

FIELD OF THE INVENTION

The present invention relates to an image forming apparatus. More particularly, the present invention relates to an image forming apparatus in which a reader is installed on a mainboard, for radio communication with a radio frequency identification (RFID) tag installed in a cartridge of the image forming apparatus.

DESCRIPTION OF THE RELATED ART

An image forming apparatus is a common name for a printer, a fax machine or an all-in-one machine that combines the functions of printer, facsimile, and the like. Recently, some image forming apparatuses use a radio communication device for accessing cartridge data.

FIG. 1 shows a conventional image forming apparatus that has a structure for radio communication between a cartridge and a main body of the image forming apparatus.

Referring to FIG. 1, an image forming apparatus includes a cartridge 10, a RFID tag 12, a reader 14, a mainboard 16, and a cable 18. In order to facilitate radio communication, the RFID tag 12 is installed on the cartridge 10, and the reader 14 is installed adjacent to the RFID tag 12 in order to read data from the RFID tag 12.

The RFID tag 12 includes a memory (not shown) for storing data, an antenna (not shown) for sending the data stored in the memory to the reader 14, and a sender (not shown) for sending the data stored in the memory to the antenna.

The mainboard 16 of the image forming apparatus is provided with a controller (not shown) for controlling an overall operation of the image forming apparatus. The cable 18 is provided for connecting the mainboard 16 and the reader 14.

The RFID tag 12 is typically disposed at a top portion or a front (cartridge insertion direction) portion of the cartridge 10. Further, the mainboard 16 is typically connected to the reader 14 through the cable 18, in order to exchange data with the RFID tag 12.

However, since the RFID tag 12 is disposed at the top portion or the front portion of the cartridge 10, the reader 14 must be installed at a location facing the top portion or the front portion of the cartridge 10. Therefore, the cable 18 is necessary to connect the reader 14 and the mainboard 16 and a separate space for installing the reader 14 is needed, such that noise can be generated by the cable 18 and the size of the image forming apparatus is increased because of the separate space.

Accordingly there is a need for an image forming apparatus having a reader integrally formed with a mainboard and within a distance from an RFID tag such that a cable connecting the mainboard and the reader is not required.

SUMMARY OF THE INVENTION

Embodiments of the present invention provide an image forming apparatus, in which a reader acting as a radio communication device is integrally formed on a mainboard, such that a cable is not required to connect the reader and the mainboard.

According to an aspect of the present invention, there is provided an image forming apparatus including a mainboard on which a reader is integrally installed, and a RFID (radio frequency identification) tag installed on a cartridge within a distance capable of radio communication with the reader.

BRIEF DESCRIPTION OF THE DRAWINGS

The above and other features and advantages of the present invention will become more apparent in connection with the following detailed description of exemplary embodiments thereof with reference to the attached drawings in which.

Throughout the drawings, it will be understood that like reference numbers refer to like elements, features and structures.

DETAILED DESCRIPTION OF THE EXEMPLARY EMBODIMENTS

Figure 1:
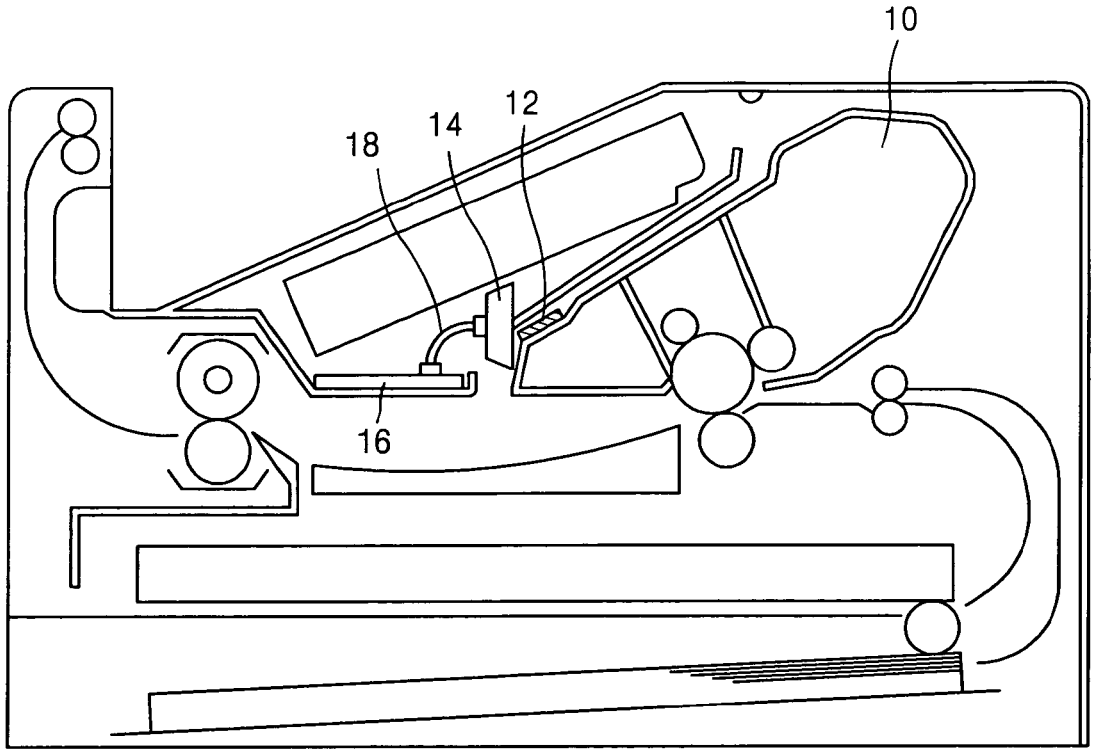
FIG. 1 (PRIOR ART)
FIG. 1 is a sectional view illustrating a structure of a conventional image forming apparatus provided with a cartridge, a reader, and a mainboard.
Figure 2A:
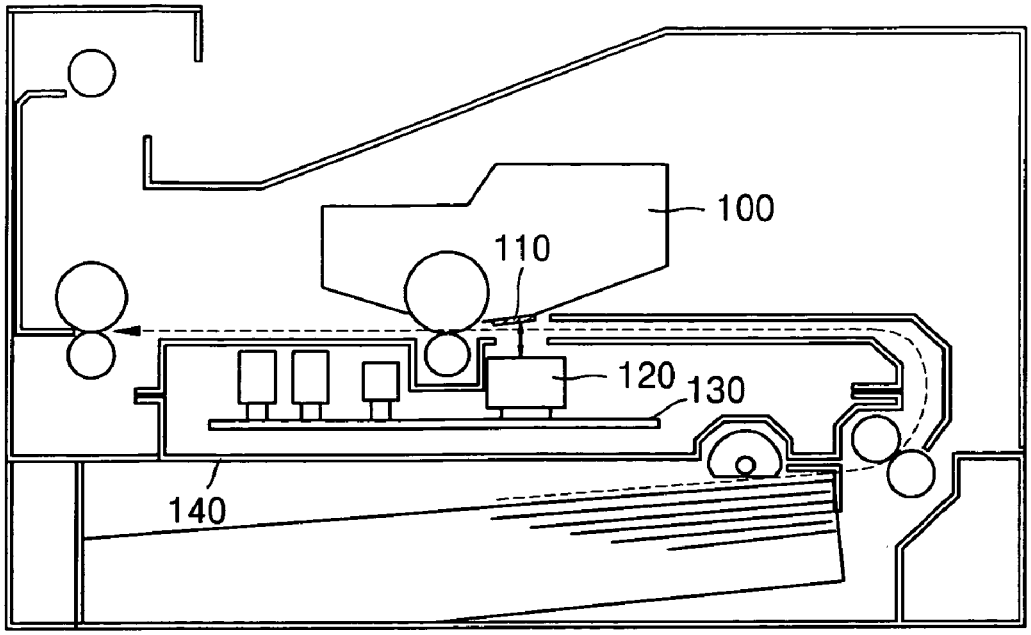
FIG. 2A is a sectional view of an image forming apparatus according to an embodiment of the present invention.

FIG. 2A is a sectional view of an image forming apparatus according to an embodiment of the present invention.

Referring to FIG. 2A, an image forming apparatus includes a cartridge 100, a radio frequency identification (RFID) tag 110, a reader 120, mainboard 130, and a housing 140. The RFID tag 110 is installed at a bottom-rear side of the cartridge 100. The reader 120 is integrally installed on the mainboard 130, arranged adjacent and facing the RFID tag 110. The mainboard 130 provided with the integrally installed reader 120 is installed within the housing 140. That is, the housing 140 surrounds the mainboard 130. The housing 140 surrounding the mainboard 130 is installed at a lower portion of the image forming apparatus.

The RFID tag 110 responds to a radio wave from the reader 120 and sends a radio frequency identification and stored data to the reader 120. The RFID tag 110 is used for a short distance transmission at low frequency.

The RFID tag 110 is adapted to be easily installed and detached from the cartridge 110 and includes a unit capable of reading and writing various data from the cartridge 100. A nonvolatile memory (not shown) is used for a memory (not shown) of the RFID tag 110 in order to store data even when power is off.

The reader 120 converts data from the RFID tag 110 and sends the converted data to a controller (not shown) of the mainboard 130. The controller compares the data from the reader 120 with a pre-stored database in order to control a necessary operation.

The reader 120 is integrally installed on the mainboard 130. Owing to the integral installation of the reader 120, a cable required in the related art to connect the reader 120 and the mainboard 130 is not required. The reader 120 can be formed into modules accord to functions, such that the reader 120 can be selectively installed on the mainboard 130 and detached therefrom.

The reader 120 can be spaced from 1 cm to 50 cm apart from the RFID tag 110. It is preferable for a stable operation of the reader 120 to space the reader 120 closer to the RFID tag 110, it is more appropriate that the reader 120 is spaced from 1 cm to 20 cm apart from the RFID tag 110 in order to prevent the reader 120 from interfering with other devices.

The mainboard 130 including the reader 120 is provided at a lower portion of the image forming apparatus.

The housing 140 surrounds the mainboard 130. The housing 140 has an opening above the reader 120, such that a radio communication between the reader 120 and the RFID tag 110 can be performed without noise. That is, the opening of the housing 140 prevents noise during a radio communication between the reader 120 and the RFID tag 110.

The entire housing 140 is preferably made of a non-conductive material. For example, the housing 140 can be made of a polymer resin such as a plastic, such that the radio communication between the reader 120 and the RFID tag 110 can be performed without noise. Further, the housing 140 can be made of a conductive material with a non-conductive portion located adjacent to the reader 120, such that the non-conductive portion allows radio communication between the reader 120 and the RFID tag 110 to be performed without noise, and such that the conductive material blocks electromagnetic waves generated from the mainboard 130.

Figure 2B:
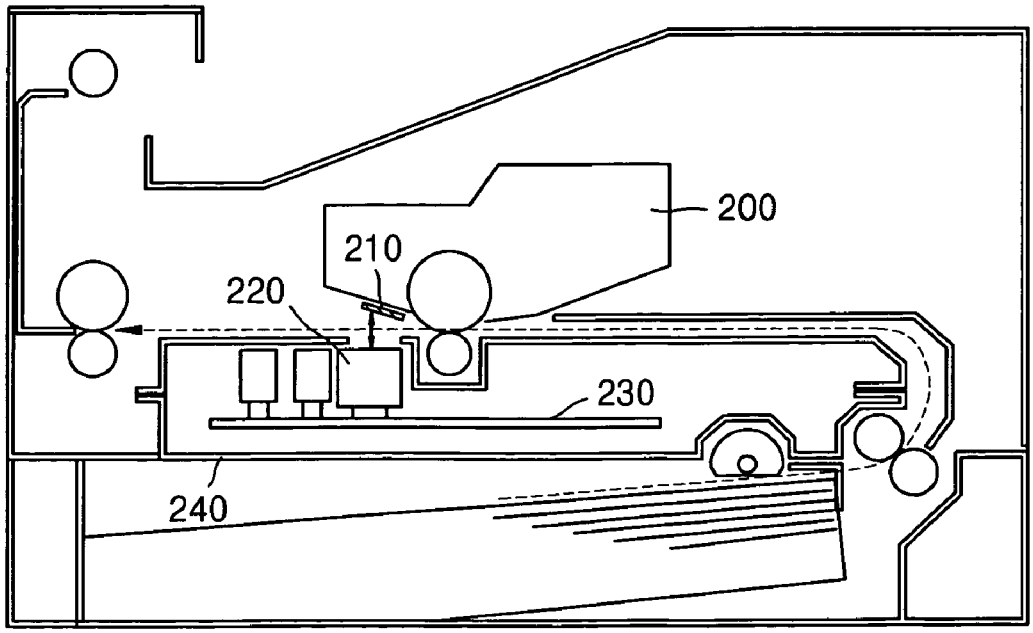
FIG. 2B is a sectional view of an image forming apparatus according to another embodiment of the present invention.

FIG. 2B is a sectional view of an image forming apparatus according to another embodiment of the present invention.

Referring to FIG. 2B, an image forming apparatus includes a cartridge 200, a RFID tag 210, a reader 220, mainboard 230, and a housing 240. The RFID tag 210 is installed at a bottom-front side of the cartridge 200. The reader 220 is integrally installed on the mainboard 230, adjacent the RFID tag 210. The mainboard 230 provided with the integrally installed reader 220 is installed within the housing 240. The housing 240 surrounding the mainboard 230 is installed at a lower portion of the image forming apparatus.

Figure 3:
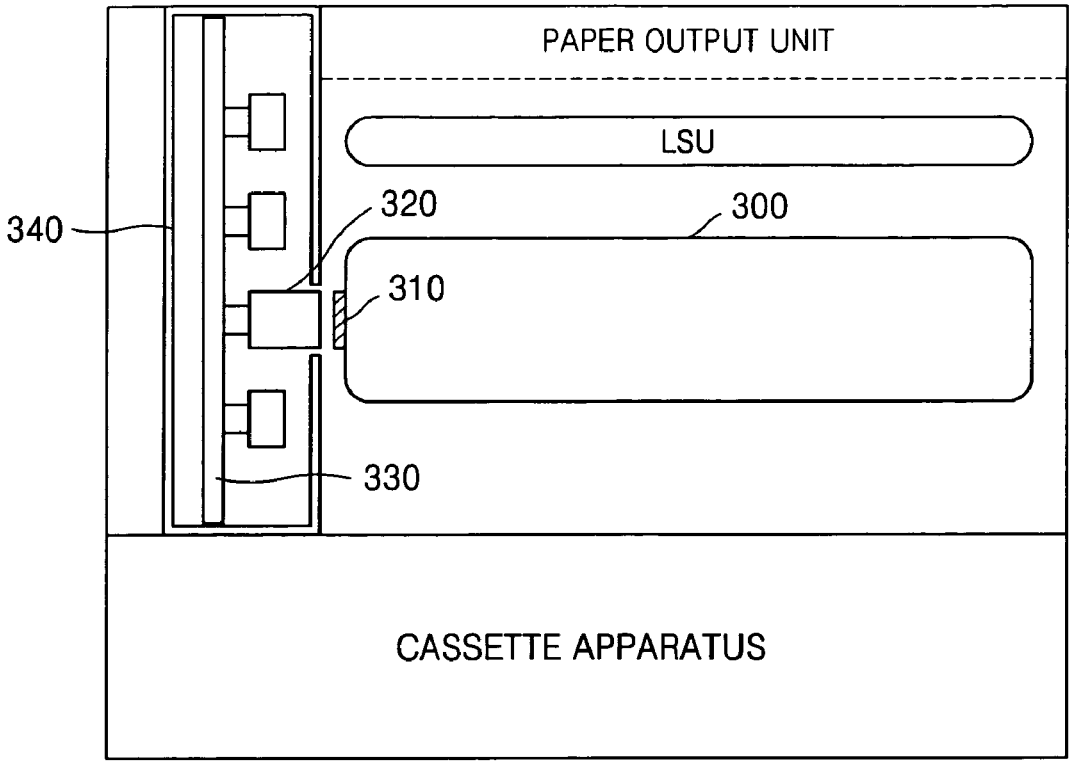
FIG. 3 is a front view of an image forming apparatus according to yet another embodiment of the present invention.

FIG. 3 is a front view of an image forming apparatus according to yet another embodiment of the present invention.

Referring to FIG. 3, an image forming apparatus includes a cartridge 300, a RFID tag 310, a reader 320, mainboard 330, and a housing 340. The RFID tag 310 is installed at a side of the cartridge 300. The reader 320 is integrally installed on the mainboard 330, adjacent the RFID tag 310. The mainboard 330 provided with the integrally installed reader 320 is installed within the housing 340. The housing 340 is installed at a side portion of the image forming apparatus.

As described above, the image forming apparatus according to an embodiment of the present invention is designed that the reader acting as a radio communication device is integrally formed on the mainboard, such that the cable connecting the reader and the mainboard is not required. Thus, noise generated by a cable can be prevented and the image forming apparatus can be conveniently assembled.

While the image forming apparatus according to embodiments of the present invention have been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An image forming apparatus comprising:

a cartridge removably installed to a fixed location within an image forming apparatus housing;

a reader performing a radio communication with the cartridge;

a mainboard on which the reader is integrally installed, the reader and mainboard being installed at a predetermined location within the image forming apparatus housing; and a radio frequency identification (RFID) tag installed on the cartridge within a distance capable of radio communication with the reader.

2. The image forming apparatus of claim 1, wherein the RFID tag is installed on a bottom of the cartridge.

3. The image forming apparatus of claim 1, wherein the mainboard is installed under the cartridge, the radio communication being performed between the reader and the RFID tag.

4. The image forming apparatus of claim 1, wherein the RFID tag is installed on a side of the cartridge.

5. The image forming apparatus of claim 4, wherein the mainboard is installed beside the cartridge, the radio communication being performed between the reader and the RFID tag.

6. The image forming apparatus of claim 1, further comprising a mainboard housing surrounding the mainboard on which the reader is installed.

7. The image forming apparatus of claim 6, wherein the mainboard housing has an opening in a predetermined position, for facilitating radio communication between the reader and the RFID tag.

8. The image forming apparatus of claim 7, wherein the mainboard housing is made of a non-conductive material around the opening thereof and the remaining portion of the mainboard housing is made of a conductive material.

9. The image forming apparatus of claim 7, wherein the mainboard housing is made of a non-conductive material.

10. The image forming apparatus of claim 1, wherein the reader is formed into modules according to functions, such that the reader can be selectively installed on the mainboard and detached therefrom.

11. An image forming apparatus comprising:

a replaceable unit removably installed to a fixed location within an image forming apparatus housing;

a reader performing a radio communication with the replaceable unit;

a mainboard on which the reader is integrally installed, the reader and mainboard being installed at a predetermined location within the image forming apparatus housing; and a radio frequency identification (RFID) tag installed on the replaceable unit within a distance capable of radio communication with the reader.

12. The image forming apparatus of claim 11, wherein the RFID tag is installed on a bottom or side of the replaceable unit.

13. The image forming apparatus of claim 11, the radio communication being performed between the reader and the RFID tag.

14. The image forming apparatus of claim 11, further comprising a mainboard housing surrounding the mainboard on which the reader is installed.

15. The image forming apparatus of claim 14, wherein the mainboard housing has an opening in a predetermined position, to facilitate radio communication between the reader and the RFID tag.

16. The image forming apparatus of claim 15, wherein the mainboard housing is made of a non-conductive material around the opening thereof and the remaining portion of the mainboard housing is made of a conductive material.

17. The image forming apparatus of claim 15, wherein the mainboard housing is made of a non-conductive material.

18. The image forming apparatus of claim 11, wherein the reader is formed into modules according to functions, such that the reader can be selectively installed on the mainboard and detached therefrom.

* * * * *